United States Patent [19]

Bunczk et al.

[11] Patent Number: 5,049,299

[45] Date of Patent: Sep. 17, 1991

[54] LIQUID LAVATORY CLEANSING AND SANITIZING COMPOSITION

[75] Inventors: Charles J. Bunczk, Norristown; Peter A. Burke, Downingtown, both of Pa.

[73] Assignee: Kiwi Brands Incorporated, Douglassville, Pa.

[21] Appl. No.: 426,793

[22] Filed: Oct. 26, 1989

[51] Int. Cl.[5] ..... C11D 3/48

[52] U.S. Cl. ..... 252/106; 424/672

[58] Field of Search ..... 252/106; 424/672

[56] References Cited

U.S. PATENT DOCUMENTS

| | | | |
|---|---|---|---|
| 3,326,806 | 6/1967 | Dolby | 252/106 |
| 3,380,923 | 4/1968 | Beach | 252/106 |
| 3,438,906 | 4/1969 | Duvall | 252/106 |
| 3,897,357 | 7/1975 | Carmello et al. | 252/106 |
| 3,917,822 | 11/1975 | Turney | 424/672 |
| 4,130,640 | 12/1978 | Chazan et al. | 424/80 |
| 4,206,204 | 6/1980 | Langford | 424/672 |
| 4,597,975 | 7/1986 | Woodward et al. | 424/672 |
| 4,793,988 | 12/1988 | Casey et al. | 252/106 |
| 4,808,328 | 2/1989 | Flohr | 252/106 |
| 4,851,149 | 7/1989 | Carandang | 252/106 |
| 4,867,897 | 9/1989 | Kolstad | 252/106 |
| 4,904,480 | 2/1990 | Khan et al. | 424/667 |
| 4,911,859 | 3/1990 | Bunczk et al. | 252/106 |

FOREIGN PATENT DOCUMENTS

| | | |
|---|---|---|
| 2508766 | 9/1975 | Fed. Rep. of Germany . |
| 2524388 | 1/1976 | Fed. Rep. of Germany . |

*Primary Examiner*—Paul Lieberman
*Assistant Examiner*—Cynthia Leslie
*Attorney, Agent, or Firm*—John Lezdey

[57] ABSTRACT

A phosphate-free liquid lavatory cleansing and sanitizing composition for use in a metering composition comprising a nonionic or anionic detergent-iodine complex, a nonionic or anionic surfactant in an amount to provide a monomer to micelle ratio of about 90:10 to 40:60, a water-soluble acid dye and water.

15 Claims, 3 Drawing Sheets

LIQUID LAVATORY CLEANSING AND SANITIZING COMPOSITION

FIELD OF THE INVENTION

The present invention relates to non-toxic phosphate-free liquid cleansing and sanitizing compositions which are useful for the treatment of the flush water of toilets. More particularly, the invention is concerned with a halophor-containing liquid composition which is metered out in response to the flushing of the toilet and produces a color which indicates the presence of the halophor.

BACKGROUND OF THE INVENTION

In treating toilet flush water with chemicals so as to produce desirable effects such as bowl aesthetics, cleaning, disinfection, deodorization, etc., it is desirable that the chemicals be dispensed into the flush water automatically each time the toilet is flushed. The prior art discloses numerous solid lavatory cleansing blocks which have the capability of automatically dispensing metered amounts of chemicals to effect cleaning and sanitizing. However, prior to the present invention liquid cleaners which contain a halophor sanitizing agent have not been available that are responsive to flushing.

Generally, the liquid cleansing compositions which are presently available do not contain a sanitizing agent. Most prior art liquid cleaners merely contain surfactants, dyes, perfumes, and other fillers to provide cleaning and sudsing with an indicator.

Automatically dispensed toilet bowl cleaning and/or sanitizing products, which contain dyes to provide a visual signal to the user that the product is being dispensed, are well known. Such products are sold in the United States under the brand names VANISH AUTOMATIC (Drackett Products), TY-D-BOL AUTOMATIC (Kiwi Brands, Inc.) and SANIFLUSH AUTOMATIC (Boyle-Midway). None of these products contains an iodophor sanitizing agent and all of them provide a color to the bowl water which persists between flushings. U.S Pat. No. 3,504,384, Radlevy et al, issued Apr. 7, 1970, discloses a dual compartment dispenser for automatically dispensing a hypochlorite solution and a surfactant/dye solution to the toilet bowl during flushing. The dye which is taught in the patent is Disulfide Blue VN150. This dye is resistant to oxidation to a colorless state by hypochlorite; thus, it provides a persistent color to the toilet bowl water, even in the presence of the hypochlorite.

In order to meet the Environmental Protection Agency's efficacy data requirements for in-tank sanitizer products claims for effectiveness, it is necessary that the user be able to determine the product effectiveness. That is, the color indicator must show that the sanitizing ingredient is still present in a sanitizing amount. Consequently, it is essential that the sanitizing agent have the same life in the sanitizing product as the color indicator.

The use of chloride or hypochloride ion as the sanitizing agent has the disadvantage that most dyes are oxidized to a colorless state and there is no visual indication that the sanitizing agent is active and working in the toilet bowl.

The use of iodine-containing formulations have been previously considered as sanitizing agents for toilets because of their greater sanitizing capabilities than chlorine-containing agents. However, the iodine-containing agents have not been previously employed in automatic dispensing liquid toilet compositions because they yield an unacceptable color in the toilet bowl. Also, prior to the present invention, phosphoric acid has been utilized in iodophor-containing cleansing compositions for stabilization.

U.S. Pat. Nos. 3,728,449 and 4,207,310 disclose iodophors which may be used in the present invention.

It is an object of the present invention to provide a liquid lavatory cleansing and sanitizing composition containing halophors which are suitable for use automatically dispensing cleaning agents into the toilet.

It is a further object of the present invention to provide a stable composition for use in metering the sanitizing effect of the iodine released in liquid iodophor-containing lavatory cleansing compositions.

It is a still further object of the present invention to provide a liquid lavatory cleaning composition wherein there is a synergistic sanitizing effect together with a dye.

SUMMARY OF THE INVENTION

The present invention provides a non-toxic phosphate-free liquid lavatory cleansing and sanitizing composition which is suitable for use with a metering container. More particularly, the invention provides a liquid composition comprising 1) a nonionic or anionic detergent iodine complex or halophor in an amount so as to provide at least 0.2% by weight, preferably, about 0.4 to about 0.8% by weight of elemental iodine; 2) a nonionic or anionic surfactant in an amount to provide a monomer to micelle ratio of about 90:10 to 40:60, preferably about 60:40, 3) about 0.5% to 10% of a water soluble acid dye, and 4) water.

It has been found that the presence of phosphates, particularly phosphoric acid, is not required for the stability of the composition if the nonionic or anionic surfactant is present in an amount to provide a monomer to micelle ratio of about 90:10 to 40:60, preferably about 60:40. To arrive at the critical micelle concentration of the various surfactants which may be utilized, reference should be made, for example, to the article of John F. Scamehorn entitled "An Overview of Phenomena Involving Surfactant Mixtures", American Chemical Society, 1986, which is herein incorporated by reference.

The compositions of this invention generally contain elemental iodine in an amount that usually does not exceed 1%, but is more generally in the range of 0.4% to 0.8% iodine. Higher amounts are not required to yield the desired biocidal effect and could interfere with the desired color.

The compositions can optionally and advantageously, also include up to about 2% of at least one water-soluble iodide selected from the group consisting of hydrogen iodide and inorganic iodides, such as potassium iodide, sodium iodide or calcium iodide. Potassium iodide is preferred.

An important attribute of the compositions of the invention is their sanitizing activity. It has been found that the new compositions possess a microbiocidal action against Staphylococcus aureus (ATCC-6538), Salmonella choleraesuis (ATCC-10708) and odor causing microorganisms Brevibacterium ammoniagenes (ATCC-6871) and Proteus Vulgaris (ATCC-8427). The microbiologic testing indicates that full germicidal activity of the iodophor is not modified by its combination into the new compositions. In fact, it has been surprisingly found that the use of the dye enhances the biocidal activity of the composition.

It has been further found that methyl dimethyl propoxylene ammonium chloride is compatible in the present composition and can be incorporated therein to provide additional biocidal activity. An amount of up to 2% by weight, preferably 0.2–0.8%, may be utilized to achieve the desired effect.

The compositions of the present invention have been found to be non-toxic when tested according to the method described in the *New and Revised Health Effects Test Guidelines* 1984, (PB84-233295), U.S. Department of Commerce, National Technical Information Service.

Other objects and a more complete understanding of the invention will be had by referring to the following description, taken in conjunction with the accompanying drawings, in which:

DESCRIPTION OF THE PREFERRED EMBODIMENTS

According to one embodiment of the invention, a liquid non-phosphate containing lavatory cleansing and sanitizing composition is provided for metering into a toilet bowl during flushing. The composition comprises an iodophor or a complex of a nonionic or anionic detergent and iodine in an amount to provide at least 0.2% by weight, preferably about 0.4 to about 0.8% by weight of elemental iodine; a nonionic or anionic surfactant in an amount to result in an equilibrium of the surfactant of monomer to micelle in a ratio of about 90:10 to 40:60, preferably about 60:40; about 0.5% to 10% of a water soluble acid dye and the remainder water. Optionally, other ingredients may be added such as a fragrance, perfume, or other biocidal agents, such as methyl dimethyl propoxylene ammonium chloride.

A suitable composition in accordance with the invention comprises an amount of iodophor or detergent-iodine complex to provide about 0.4 to 0.8% by weight of elemental iodine. Utilizing a commercial product of West Agro Inc. sold under the name "Clean Front Concentrate" which is an alpha-(p-nonylphenyl)-omegahydroxypoly (oxyethylene)-iodine complex, the amount is about 1.9 to 4.0 percent by weight of composition. The amount of anionic or nonionic surfactant is generally about 2% to 8% by weight depending upon the surfactant and the iodophor utilized. The acid dye in the amount of about 0.5% to 10% provides a suitable color to the composition. The remainder of the ingredients is water and any optional materials that may be added.

Figure 3:
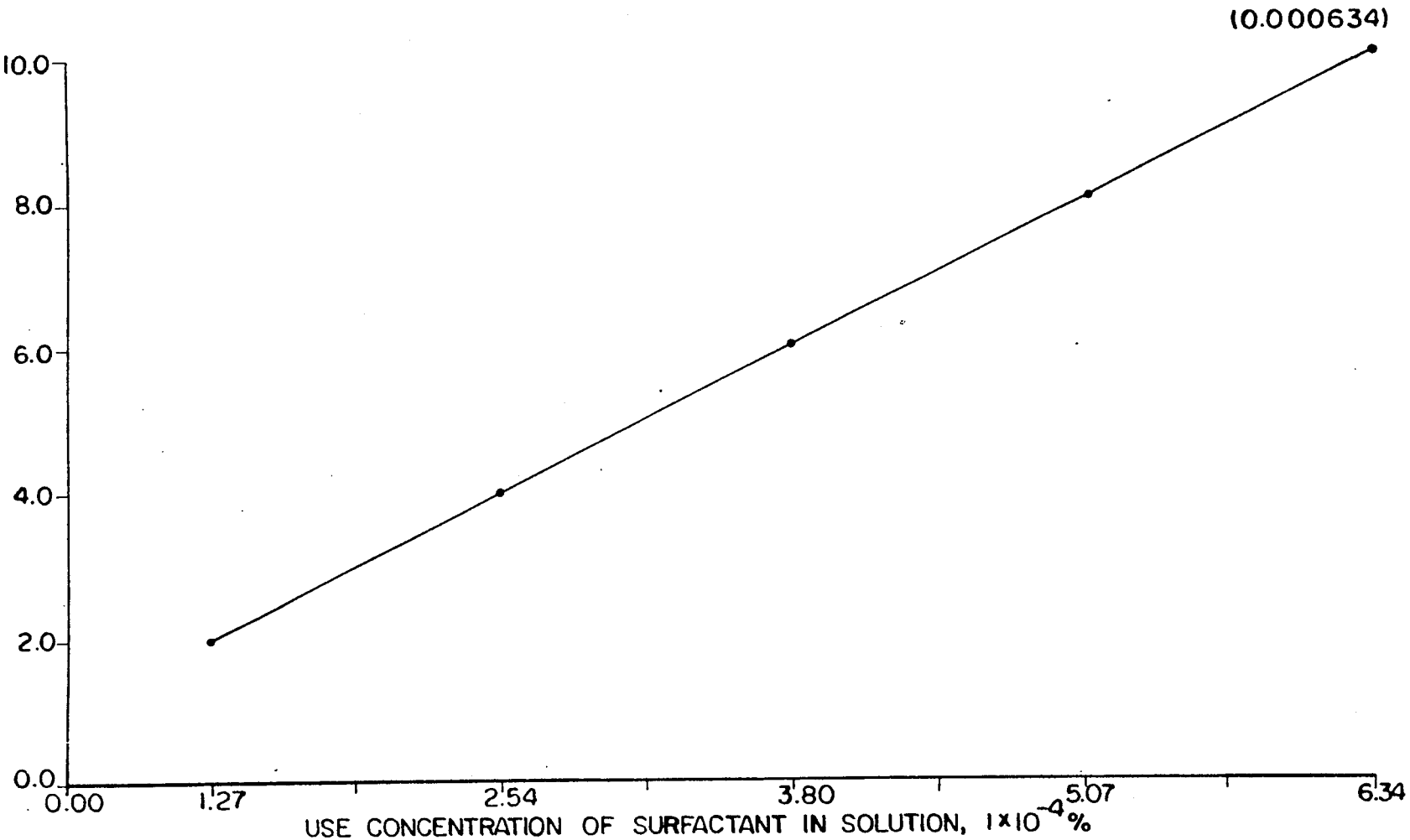
FIG. 3 shows that the surfactant concentration of a composition of the invention yield monomers.

A typical product which will be utilized in a household comprises about 360 g of composition per dispenser bottle. The amount is generally appropriate for 300 average flushes. There is generally about 18,925 g of dilution water per flush which amounts to 5,677,500 cc of water utilized with the product. In FIG. 3 there is shown that the surfactant concentration of a typical formulation yields monomers in solution since the product is below the Critical Micelle Concentration for the surfactants employed. The total surfactant concentration based o the iodophor is about 70%.

Surfactants in aqueous solutions generally exist in a state of equilibrium between micelles and a monomeric state. The monomer-micelle equilibria is dictated by the tendency of the surfactant components to form micelles and the interaction between surfactants in the micelle. The Critical Micelle Concentration (CMC) is the lowest surfactant concentration at which micelles form. The lower the Critical Micelle Concentration, the greater the tendency of the system to form micelles. The Critical Micelle Concentration is the concentration at which the micelles make this first appearance.

In situations where a quantitative estimate of the amount or concentration of micelles is desired, for example, in estimating solubilizing powers, or the effect of micelle concentrations on the chemical reactivities of constituent monomers or solubilized species, an area of research which is of considerable current interest, the CMC serves the purpose of giving a rough estimate of the monomer concentration in the solution. The micelle concentration in equivalents, therefore, can be closely approximated as the total concentration minus the CMC.

The method of determining the Critical Micelle Concentration (CMC) of surfactants is disclosed in article of Mukerjee et al entitled "Critical Micelle Concentration of Aqueous Surfactant Systems", National Bureau of Standards publication N SRDS-NBS 36 (1971), which is herein incorporated by reference. One of the methods disclosed involves the measurement of surface tension such as by the du Nouy ring detachment method.

Aqueous solutions of nonionic surfactants exhibit significantly lower surface tensions and consequently better wetting characteristics than water alone. In very dilute solutions, as surfactant concentration increases, surface tension decreases. This effect continues until a particular concentration is reached after which the surface tension remains nearly constant as surfactant concentration. This particular concentration is the "Critical Micelle Concentration" of the particular surfactant.

Table I describes the surface tension of some commercially available ethoxylated non-ionic surfactants.

TABLE I

| | Concentration % weight | | | | | |
|---|---|---|---|---|---|---|
| | Surface Tensions Dynes/cm @ 24.4 C. in water | | | | | CMC |
| Surfactant | 0.0001 | 0.001 | 0.01 | 0.1 | 1.0 | % wt |
| NEODOL 91-6 | 62 | 53 | 33 | 29 | 29 | 0.025 |
| NEODOL 91-8 | 63 | 54 | 37 | 30 | 31 | 0.027 |
| NEODOL 23-6.5 | 53 | 33 | 28 | 28 | 28 | 0.0017 |
| NEODOL 25-7 | 51 | 32 | 30 | 30 | 30 | 0.0009 |
| NEODOL 25-9 | 54 | 35 | 31 | 30 | 30 | 0.0018 |
| NEODOL 25-12 | 59 | 39 | 34 | 34 | 34 | 0.0018 |
| NEODOL 45-7 | 46 | 31 | 29 | 29 | 29 | 0.0004 |
| NEODOL 45-13 | 50 | 41 | 36 | 34 | 33 | 0.006 |
| Linear 1012 primary alcohol (5.2EO) | 58 | 42 | 27 | 26 | 26 | 0.0035 |
| Random secondary alcohol (7EO) | 53 | 36 | 30 | 29 | 20 | 0.0025 |
| Nonylphenol (9EO) | 57 | 42 | 32 | 32 | 32 | 0.0025 |
| Octylphenol (9.5EO) | 58 | 49 | 31 | 30 | 30 | 0.011 |
| Linear 812 primary alcohol EO/PO nonionic (HLB13) | 63 | 50 | 32 | 29 | 30 | 0.013 |

TABLE I-continued

| Surfactant | Concentration % weight Surface Tensions Dynes/cm @ 24.4 C. in water 0.0001 | 0.001 | 0.01 | 0.1 | 1.0 | CMC % wt |
|---|---|---|---|---|---|---|
| Tridecyl alcohol ethoxylate (HLB 13.1) 85% AM | 56 | 42 | 27 | 27 | 27 | 0.0077 |

The class of iodophors or detergent-iodine complexes which are utilized in the present invention are iodine-synthetic detergent complexes such as prepared according to the process as disclosed in U.S. Pat. Nos. 2,977,315 and 4,271,149. The synthetic detergent can comprise one or more nonionic and/or anionic surface active agents having strong detergent and wetting properties.

The nonionic carriers suitable for use in the compositions include all of the known nonionic carriers or complexing agents for iodine, but the preferred carriers are the ethoxylated nonionic detergent types which have been cleared for us in contact with food equipment. Suitable nonionic carriers include:

a. alkyl phenol ethylene oxide condensates wherein the alkyl group contains 8–12 carbon atoms and the condensate contains about 7–18 mols of ethylene oxide per mol of alkyl phenol.

b. nonionics of the type disclosed in the U.S. Pat. No. 2,759,869 and generally embraced by the formula:

$$HO(C_2H_4O)_x(C_3H_6O)_y(C_2H_4O)_{x'}—H$$

wherein y equals at least 15 and $(CH_2H_4O)-x+x'$ equals 20 to 90 percent of the total weight of said compound.

c. nonionics which are ethoxylated partial esters of fatty acids with sugar alcohols such as sorbitol and suitably those containing an average of 1–3 ester groups and up 50 mols of ethylene oxide per molecule.

d. butoxy derivatives of polypropylene oxide, ethylene oxide, block polymers having molecular weights within the range of about 2,000–5,000.

e. nonionics represented by the formula:

$$(C_nH_{2\,n+1})\,C_6H_4\,(OCH_2CH_2)$$

where n equals at least 7 and $(OCH_2CH_2)$ equals 58 to 78 percent of the total weight of said component.

f. poly(N-vinyl-2-pyrrolidone) (P.V.P.), and g. mixtures thereof.

Typical nonionic carriers falling within these types which are commercially available, and some of which utilized in the examples hereinafter appearing, include the following nonionic detergents:

"Igepal CO-630"=nonylphenol condensed with 9–10 moles of ethylene oxide

"Igepal CO-710"=nonylphenol condensed with 10–11 moles of ethylene oxide

"Igepal CO-730"=nonylphenol condensed with 15 moles of ethylene oxide

"Pluronic L62"=25 to 30 moles of polyoxypropylene condensed with 8.5 to 10.2 moles of ethylene oxide "Pluronic F68"=25 to 30 moles of polyoxypropylene condensed with 33 to 41 moles of ethylene oxide "Pluronic P85"=36 to 43 moles of polyoxypropylene condensed with 48 to 52 moles of ethylene oxide "Tween 21"=polyoxyethylene (4) sorbitan monolaurate "Tween 40"=polyoxyethylene (20) sorbitan monopalimitate "Tergitol XH"=butoxy monoether of mixed (ethylene-propylene) polyalkylene glycol having a cloud point of 90–100° C. and an average molecular weight of 3,300.

Preferred nonionics are the water-soluble condensation products of aliphatic alcohols containing from 8 to 22 carbon atoms, in either straight chain or branched configuration, with from 9 to 15 moles of ethylene oxide per mole of alcohol. Particularly preferred are the condensation products of alcohols having an alkyl group containing from about 9 to 15 carbon atoms with from about 9 to 12 moles of ethylene oxide per mole of alcohol.

The detergents or surfactants which form the iodophor can be the same or different from the surfactants which solubilize the iodophor.

Among the suitable anionic surface active agents which can be used for the formation of iodophors or as solubilizers in accordance with the present invention are those represented by the formula:

$$R-\underset{\underset{R'}{|}}{N}-CH_2-CH_x-SO_3-Y$$

wherein R is the radical $C_xH(2_x30\ 1)$ CO; x being an integer of from 5 to 17 and R' is selected from group consisting of hydrogen, $(C_1-C_4)$ alkyl and cyclohexyl radicals and Y is selected from the group consisting of salt-forming cations. The preferred anionic detergent compounds are of the well known groups of anionic surface active agents known as alkanoyl taurates and alkylaryl sulfonates such as alkyl benzene sodium sulfonate and alkyl naphthyl sodium sulfonate. A preferred anionic surfactant is sodium methyl cocoyltaurate.

Other anionic surfactants suitable for use herein as solubilizers are the sodium alkyl glyceryl ether sulfonates, especially those ethers of higher alcohols derived from tallow and coconut oil; sodium coconut oil fatty acid monoglyceride sulfonates and sulfates; sodium or potassium salts of from about 1 to about 10 units of ethylene oxide per molecule and from about 8 to about 12 carbon atoms in the alkyl group; and sodium or potassium salts of alkyl ethylene oxide ether sulfates containing from about 1 to about 10 units of ethylene oxide per molecule and from about 10 to about 20 carbon atoms in the alkyl group.

Other useful anionic surfactants include the water soluble salts of esters of alpha-sulfonated fatty acids containing from about 6 to 20 carbon atoms in the fatty acid group and from about 1 to 10 carbon atoms in the ester group; water-soluble salts of 2-acyloxy-alkane-1-sulfonic acids containing from about 2 to 9 carbon atoms in the acyl group and from about 9 to 23 carbon atoms in the alkane moiety; alkyl ether sulfates containing from about 10 to 20 carbon atoms in the alkyl group and from about 1 to 30 moles of ethylene oxide; water-soluble salts of olefin sulfonates containing from about 12 to 24 carbon atoms; and beta-alkyloxy alkane sulfonates containing from about 1 to 3 carbon atoms in the alkyl group and from about 8 to 20 carbon atoms in the alkane moiety.

Examples of suitable dyes are Alizarine Light Blue B (C.I.63010), Carta Blue Vp (C.I. 24401), Acid Green 2G (C.I. 42085), Astragn Green D (C.I. 42040), Supranol Cyanine 7B (C.I. 42675), Maxilon Blue 3RL (C.I. Basic Blue 18), Alizarine Light Blue H-RL (C.I. Acid Blue 182), FD&C Blue No. 1, FD&C Green No. 3 and Acid Blue No. 9. Others are disclosed in the aforementioned U.S. Pat. Nos. 4,310,434 and 4,477,363, which are herewith incorporated by reference.

The liquid compositions may also contain perfumes to impart an acceptable odor to the flushing water. The perfume should be water soluble and is suitably present in an amount up to 10% by weight. In this connection, it may be noted that the term "perfume" is intended to refer to any material giving an acceptable odor and thus materials giving a "disinfectant" odor such as essential oils, pine extracts and terpinolenes. Other suitable perfumes or fragrances are disclosed in U.S. Pat. No. 4,396,522 of Callicott et al, which is herein incorporated by reference.

If desired, other halophors may be added, for example, bromophors such as dibromopropamidine isethionate (sold under the trademark BROMOPOL), bromochlorodimethyl hydantoin, dibromodimethyl hydantoin, and 2-cyano-2, 2-dibromo acetamide, preferably in an amount up to about 5% by weight.

The present invention can be more fully appreciated from the following examples, which are given for illustrative purposes only and not to limit the invention. In the following examples and through the specification all percentages are percentages by weight unless otherwise indicated.

EXAMPLE 1

A liquid toilet bowl cleansing composition for use in a metering container is prepared by mixing the following:

| Ingredient | % by weight |
|---|---|
| Iodophor | 1.9–4 |
| Surfactant | 2–8 |
| Acid dye | 0.5–10 |
| Deionized water | QS |
| | 100.0 |

metering of said composition provides the toilet bowl with about 2 to 5 ppm of dye.

EXAMPLE 2

A liquid toilet bowl cleansing composition was prepared by mixing the following:

| Ingredient | Amount % weight |
|---|---|
| alpha-(p-Nonylphenyl) omega-hydroxypoly (oxyethylene)-iodine complex | 3.8 |
| Igepal CO-630 (surfactant) | 4.0 |
| Acid Blue 9 dye | 1.5 |
| Acid Yellow 23 dye | 0.6 |
| Water | 90.1 |
| | 100.0 |

The composition has a pH of 2.3.

The composition is then placed into a metering container which is responsive to the flushing of toilets.

EXAMPLE 3

A liquid toilet bowl cleansing composition is prepared by mixing the following:

| Ingredients | Amount % weight |
|---|---|
| alpha-(p-nonylphenyl)-omega-hydroxypoly (oxyethylene)-iodide complex | 3.8 |
| Igepal CO-630 | 4.0 |
| Igepal CO-730 | 1.0 |
| Potassium iodide | 0.2 |
| Acid Blue 9 dye | 1.5 |
| Acid Yellow 23 dye | 0.6 |
| Water | 88.9 |
| | 100.0 |

The specific gravity of the composition was 1.02+0.01.

Optionally, about 1% by weight of a perfume, for example, pine oil may be added. The results of efficacy testing of the composition based on EPA Efficacy Data Requirements in a metered dosage container is shown in the following Table II.

TABLE II

| TOILET # | FLUSH | TITRATABLE IODINE (PPB) | PRODUCT LIFE (FLUSHES) | CONTACT TIME NEEDED TO ACHIEVE 99.9% KILL (MINS.) STAPH. | SALM. | BREVI. | PROT. |
|---|---|---|---|---|---|---|---|
| | | | A. 10°-15° C. Toilets | | | | |
| 19 | 6 | 278 | 254 | 30 | 30 | 10 | 10 |
| | 150 | 276 | | 30 | 30 | 10 | 10 |
| | 231 | 334 | | — | — | — | — |
| | 240 | 349 | | 30 | 30 | 10 | 10 |
| 20 | 6 | 303 | 290 | 30 | 30 | 10 | 10 |
| | 150 | 297 | | 30 | 30 | 10 | 10 |
| | 231 | 282 | | — | — | — | — |
| | 240 | 259 | | 30 | 30 | 10 | * |
| 21 | 6 | 339 | 308 | 30 | 30 | 10 | 10 |
| | 150 | 364 | | 30 | 30 | 10 | 10 |
| | 231 | 247 | | — | — | — | — |
| | 240 | 227 | | 30 | 30 | 10 | * |
| | | | B. 25°-30° C. TOILETS | | | | |
| 22 | 6 | 184 | 260 | 30 | 30 | 10 | 10 |
| | 150 | 276 | | 30 | 30 | 10 | 10 |
| | 231 | 334 | | — | — | — | — |
| | 240 | 349 | | 30 | 30 | 10 | 10 |

Bowl Inlet Water Analyses - <0.02 ppm total available chlorine 7.1 to 7.8 pH
*Experimental Error - No result

EXAMPLE 4

A liquid toilet bowl cleansing composition for use in metering container is prepared by mixing the following ingredients.

| Ingredients | Amount % weight |
|---|---|
| alpha-(p-nonylphenyl)-omega-hydroxypoly (oxyethylene)-iodide complex | 4.5 |
| Igepal CO-630 | 4.0 |
| Potassium iodide | 0.2 |
| Methyl dimethyl propoxylene ammonium chloride | 0.5 |
| Acid Blue 9 dye | 2.0 |
| Water | 88.8 |
| | 100.0 |

EXAMPLE 5

| Ingredient | Amount % weight |
|---|---|
| alpha(p-nonylphenyl)omega hydroxypropyl (oxyethylene) iodine complex | 3.8 |
| Igepal CO-630 (9 to 9.5 E.O.) | 4.0 |
| Acid Blue 9 dye | 1.3 |
| Water | 90.9 |
| | 100.0 |

Figure 1:
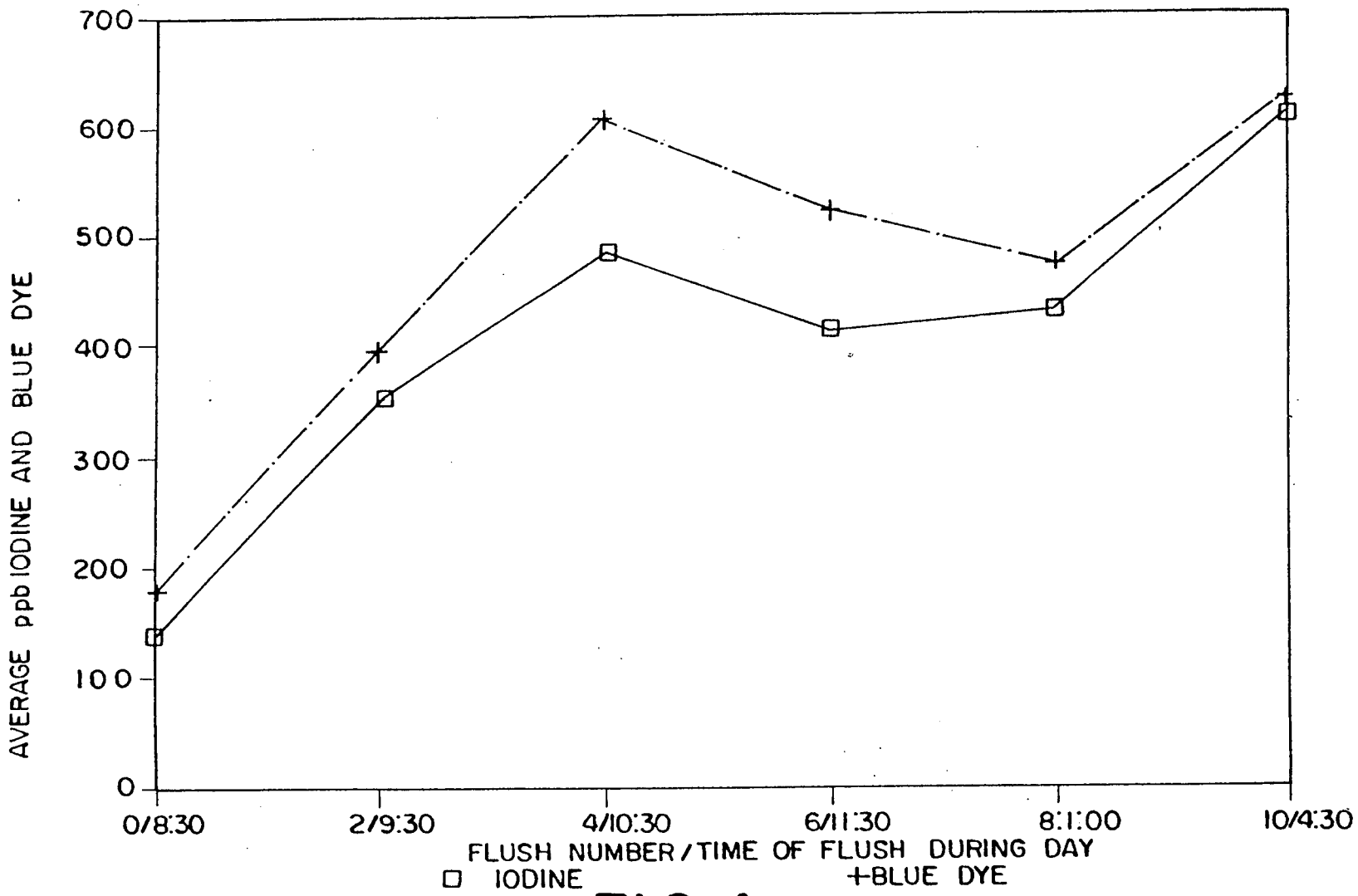
FIG. 1 shows the dye and iodine concentrations of the composition of the invention in a toilet bowl after a series of flushings.

The concentration of the dye and iodine in the toilet bowl after a series of flushing is shown in FIG. 1.

EXAMPLE 6

A liquid toilet bowl cleansing composition for metering into a toilet bowl is prepared by admixing the following ingredients:

| Ingredient | Amount % weight |
|---|---|
| Clean Front concentrate | 3.35 |
| Igepal CO-630 | 3.50 |
| Acid Blue No. 9 dye | 1.30 |
| Water | QS |
| | 100.0 |

Figure 2:
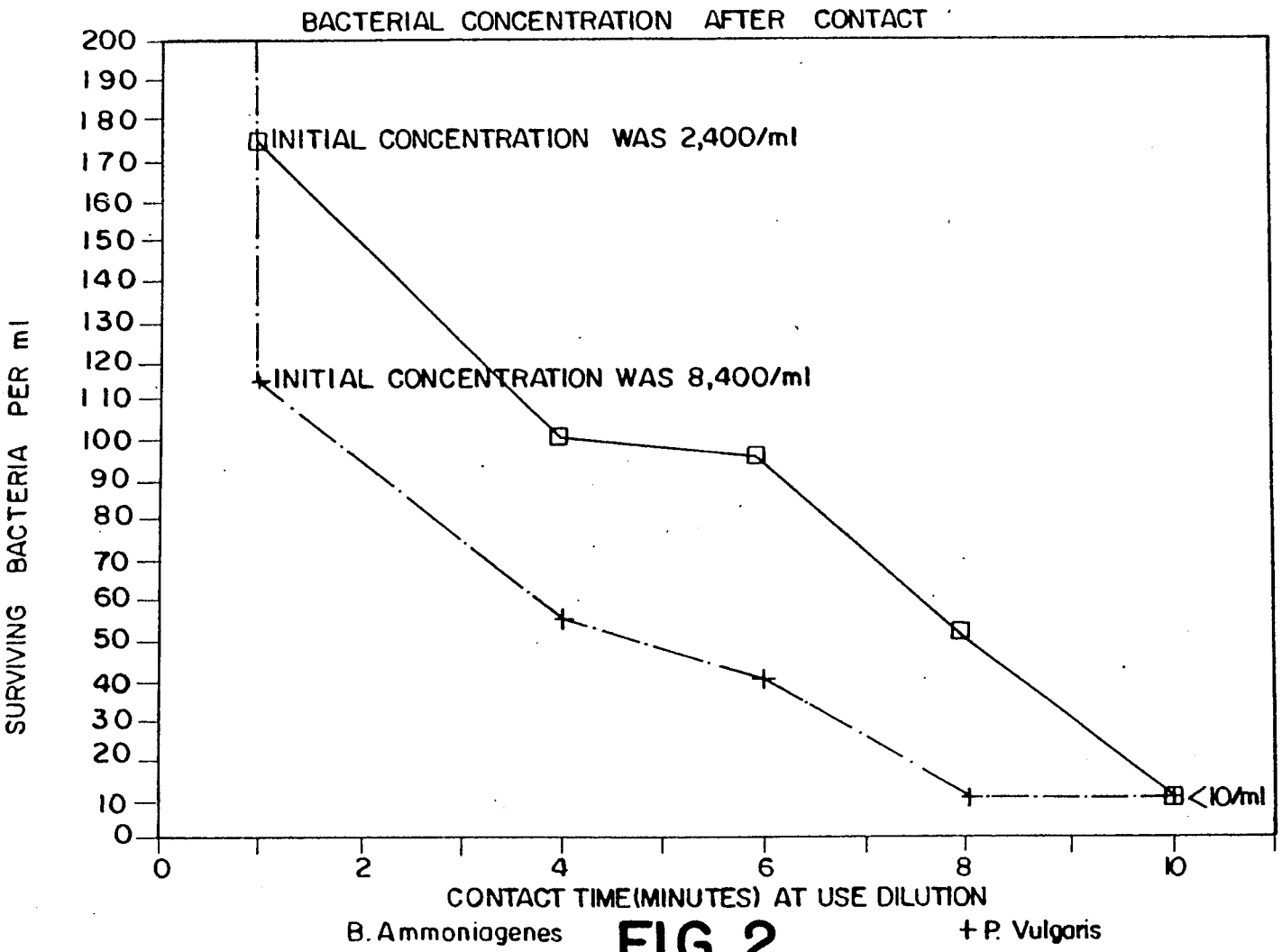
FIG. 2 illustrates the sanitizing properties of a composition of the invention.

The sanitizing properties of the prepared formulation is shown in FIG. 2.

EXAMPLE 7

A liquid lavatory composition for a metering container was prepared from the following ingredients:

| Ingredient | Amount % weight |
|---|---|
| Alpha-(P-Nonylphenol) Omega-Hydroxypoly (Oxyethylene) Iodine Complex | 3.8 |
| Igepal CO-630 (Surfactant) | 4.0 |
| Dodecyl Benzene Sulfonic Acid (Surfactant) | 1.0 |
| Acid Blue 9 Dye | 1.5 |
| Potassium Iodide | 0.2 |
| Water | 89.5 |
| | 100.0 |

EXAMPLE 8

A liquid lavatory composition for a metering container was prepared from the following ingredients:

| Ingredient | Amount % weight |
|---|---|
| Alpha-(P-Nonylphenol) Omega-Hydroxypoly (Oxyethylene)-Iodine Complex | 3.8 |
| Igepal CO-630 (Surfactant) | 4.0 |

-continued

| Ingredient | Amount % weight |
|---|---|
| Dodecyl Benzene Sulfonic Acid (Surfactant) | 2.0 |
| Acid Blue 9 Dye | 1.5 |
| Potassium Hydroxide to PH 2.5-3.0 | |
| Water (QS to 100%) | |
| | 100.0 |

EXAMPLE 9

A liquid lavatory composition for a metering container was prepared for the following ingredients:

| Ingredient | Amount % weight |
|---|---|
| Alpha-(P-Nonylphenol) Omega-Hydroxypoly (Oxyethylene)-Iodine Complex | 3.8 |
| Dodecyl Benzene Sulfonic Acid (Surfactant) | 5.0 |
| Acid Blue 9 Dye | 1.5 |
| Potassium Iodide | 0.2 |
| Water | 89.5 |
| | 100.0 |

What is claimed is:

1. A phosphate-free liquid lavatory cleansing and sanitizing composition free of an oxidizing agent for use in a metering container consisting essentially of:

a nonionic or anionic detergent-iodine complex in an amount to provide at least 0.2% by weight of elemental iodine;

a nonionic or anionic surfactant in an amount about 2% by weight to a concentration of surfactant less than the critical micelle concentration in use;

about 0.5% to 10% of a water-soluble acid dye, water, up to about 2% by weight of a water soluble iodide, and optionally water soluble fillers.

2. The composition of claim 1 wherein said complex is a nonionic detergent-iodine complex.

3. The composition of claim 2 wherein the nonionic detergent of the complex is selected from the group consisting of:

alkyl phenol ethylene oxide condensates wherein the alkyl group contains 8-12 carbon atoms of the formula:

$$(C_nH_{2n+1})\ C_6H_4\ (OCH_2CH_2)_xOH$$

wherein n equals at least 7 and x is 7 to 18, nonionics represented by the formula:

$$HO(C_2H_4O)_x\ (C_3H_6O)_y\ (C_2H_4O)_{x'}—H$$

where y equals at least 15 and $(C_2H_4O)_{x+x'}$ equals 20 to 90 percent of the total weight of said component, nonionics which are ethoxylated partial esters of fatty acids with sugar alcohols containing an average of 1-3 ester groups and up to 50 moles of ethylene oxide per molecule, butoxy derivatives of polypropylene oxide, ethylene oxide, block polymers have molecular weights within the range of about 2,000-5,000, and mixtures thereof.

4. The composition of claim 2 wherein the nonionic detergent is an alkyl phenol-ethylene oxide condensate.

5. The composition of claim 4 wherein said complex is alpha(p-nonylphenyl)omega-hydroxypoly (oxyethylene)-iodine complex.

6. The composition of claim 1 wherein said complex is present in an amount of about 0.2% to 1%.

7. The composition of claim 1 wherein the surfactant is nonionic.

8. The composition of claim 7 wherein the surfactant is nonylphenol ethoxylate.

9. The composition of claim 1 including at least one water-soluble iodide selected from the group consisting of hydrogen iodide and inorganic iodides.

10. The composition of claim 9 wherein said iodide is potassium iodide.

11. The composition of claim 1 including a biocidal effective amount of methyl dimethyl propoxylene ammonium chloride.

12. A phosphate-free lavatory cleansing and sanitizing composition for use in a metering container consisting essentially of:

about 1.9 to 4% by weight of a nonionic detergent-iodine complex;

about 2 to 8% by weight of a nonionic surfactant, said surfactant giving a concentration of surfactant less than the critical micelle concentration in use, about 0.5% to 10% by weight of an acid dye; up to about 2% by weight of a water soluble iodide, water, and optionally water soluble filters.

13. The composition of claim 12 including about 0.2 to 0.4% by weight of potassium iodide.

14. The composition of claim 12 wherein said composition provides a lavatory with 2–5 ppm of dye.

15. A phosphate-free liquid lavatory cleansing and sanitizing composition free of an oxidizing agent for use in a metering container consisting essentially of:

a nonionic or anionic detergent-iodine complex in an amount to provide at least 0.2% by weight of elemental iodine;

a nonionic surfactant in an amount of about 2to 8% by weight so as to provide a concentration of surfactant less than the critical micelle concentration in use, about 0.5% to 10% by weight of a water-soluble acid dye, water, up to about 2% by weight of a water-soluble iodide, and optionally water soluble fillers.

* * * * *